United States Patent [19]

Rivers

[11] 3,973,686

[45] Aug. 10, 1976

[54] PLURAL CONTACTING ELEVATORS WITH INCLINED PLATFORMS

[76] Inventor: Charles F. Rivers, 15318 Warwick Road, Detroit, Mich. 48223

[22] Filed: July 10, 1974

[21] Appl. No.: 486,950

[52] U.S. Cl. ..... 214/95 R; 214/622

[51] Int. Cl.[2] ..... B65G 47/00

[58] Field of Search ..... 214/95 R, 100, 622, 214/16.1 EC; 187/12, 67, 97, 94

[56] References Cited

UNITED STATES PATENTS

| | | | |
|---|---|---|---|
| 414,516 | 11/1889 | Gehrke | 214/95 R |
| 1,782,410 | 11/1930 | Cook | 214/16.1 B |
| 3,494,434 | 2/1970 | Rivers | 214/622 X |
| 3,750,849 | 8/1973 | Berkovitz | 187/94 |
| 3,802,579 | 4/1974 | Genest et al. | 214/16.1 EC |
| 3,860,130 | 1/1975 | Frangos | 214/16.1 B |

FOREIGN PATENTS OR APPLICATIONS

| | | | |
|---|---|---|---|
| 370,941 | 10/1920 | Germany | 187/67 |
| 1,182,573 | 11/1964 | Germany | 187/67 |
| 1,229,259 | 11/1966 | Germany | 214/16.1 B |
| 336,976 | 6/1959 | Switzerland | 214/16.1 EC |
| 495,189 | 11/1938 | United Kingdom | 214/16.1 EC |

*Primary Examiner*—Robert J. Spar
*Assistant Examiner*—R. B. Johnson
*Attorney, Agent, or Firm*—Whittemore, Hulbert & Belknap

[57] ABSTRACT

A loader comprising an upright frame having only two elevators or rams for transferring parts from one to the other and raising them to a point where they may be discharged. One ram moves up while the other moves down. They meet at a midpoint where parts are transferred from one to the other after which one ram goes down to pick up another load of parts and the other rises to an upper limit where the parts are discharged. A simple rack and gear drive is employed. Switches are provided to reverse the motor at the ends of the ram travel.

4 Claims, 6 Drawing Figures

PLURAL CONTACTING ELEVATORS WITH INCLINED PLATFORMS

SUMMARY OF THE INVENTION

It is a general object of this invention to provide an improved yet simplified loader construction.

The loader about to be described is somewhat similar to that disclosed in my earlier U.S. Pat. No. 3,494,434 but is simpler and has fewer moving parts to cause wear and trouble. In that patented construction, an intermediate platform or parts-transfer station is provided, and the two elevators or rams to up and down together.

In the arrangement about to be described, no intermediate shelf or platform is required and moreover the two elevators or rams move in opposite directions by a rack and gear drive so as to balance the load and place a minimum of stress on the drive. The rack and gear arrangement makes it possible for the rams to travel an unlimited distance, permitting the use of only two rams for any given height. My new loader has only three places where material can jam and cause trouble, and means are provided to make the necessary adjustments to prevent jamming.

Further objects of the invention include the provision of a loader in which adjustment to maintain clearances between the rams is simplified because of the need to adjust only one of the rams. In addition, the driving racks and gears are placed away from falling dirt and scale. The rams are cushioned by springs at the end of their down strokes to prevent shock and wear. These springs also determine the lower limit of travel.

As another feature of my invention, the rams have side retainers which prevent materials from falling off the rams between the rams and the sides of the casing, thereby requiring keeping a close tolerance only at the front plates of the two rams.

Other objects and advantages of the invention will become more apparent as the description proceeds, especially when taken in conjunction with the accompanying drawings wherein.

Figure 1:
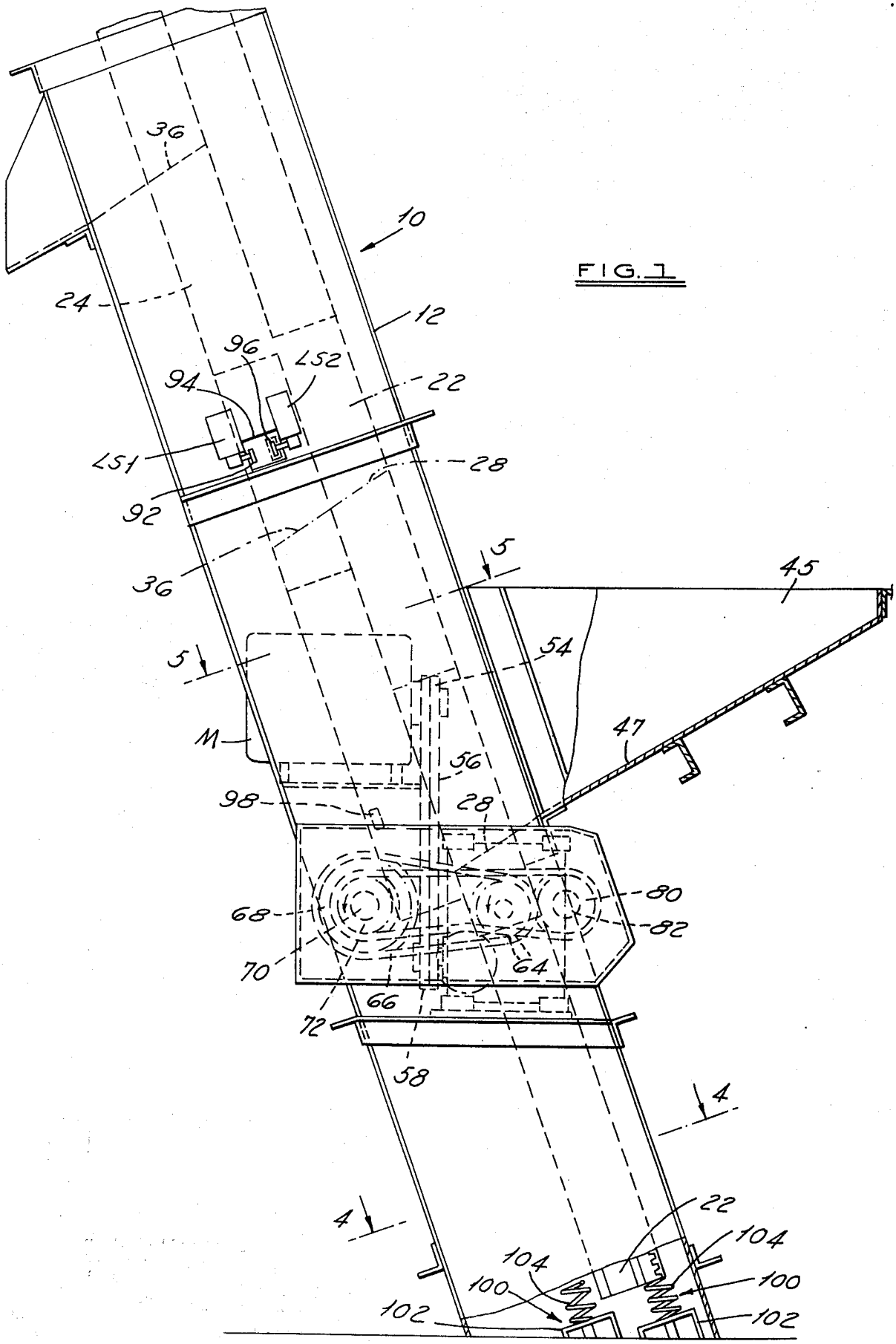
FIG. 1 is a side elevational view with parts in section of a loader constructed in accordance with my invention.
Figure 2:
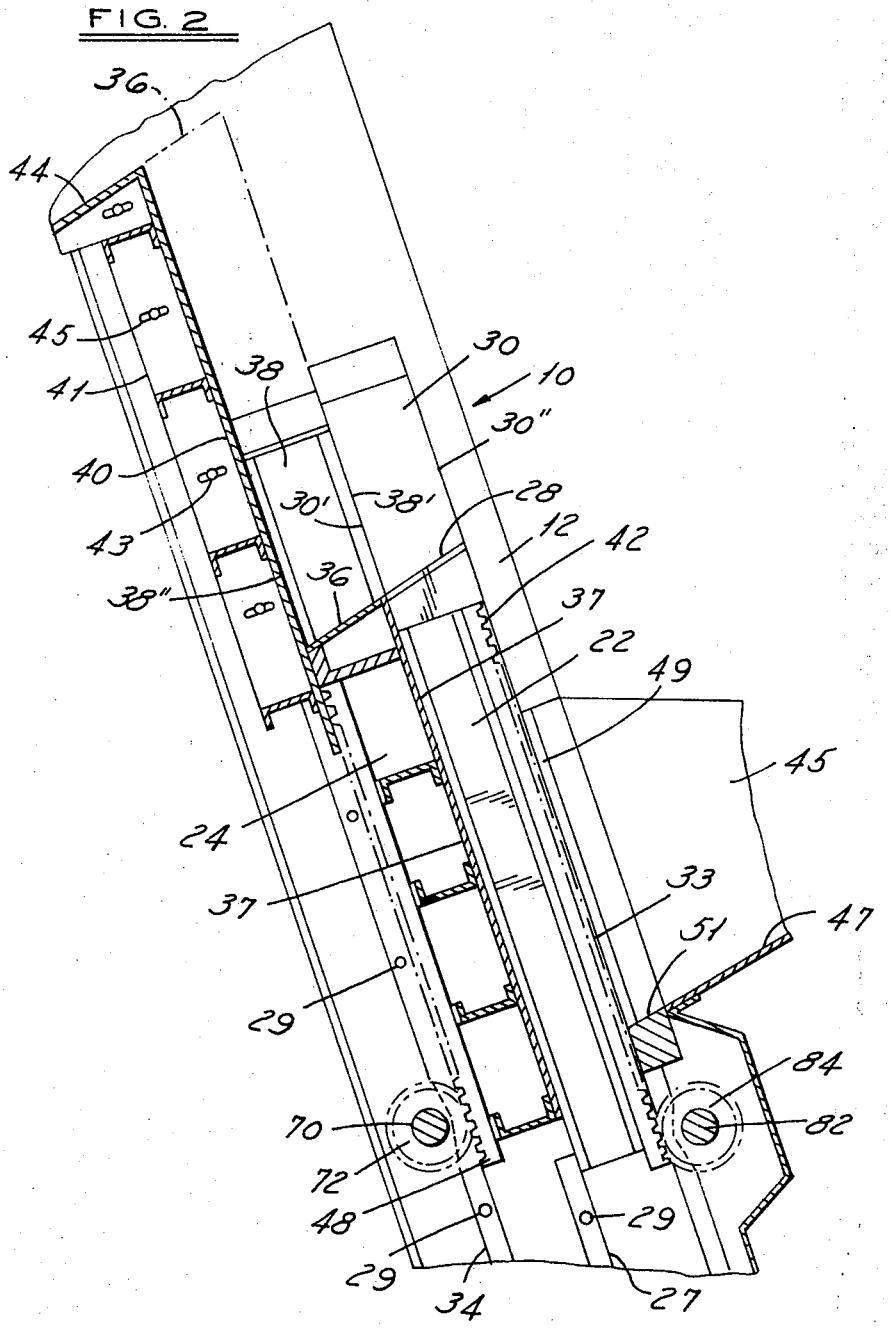
FIG. 2 is a fragmentary view similar to FIG. 1 with parts broken away and in section.

Referring now more particularly to the drawings, 10 is a loader having a generally upright frame 12 which in this instance is tipped rearwardly or to the left in FIGS. 1 and 2. The frame 12 includes the elongated longitudinally extending corner angle members 14 which define the rectangular outline of the frame. Parallel side walls 18 and 20 extend between the angle members to define the sides of the frame.

Figure 3:
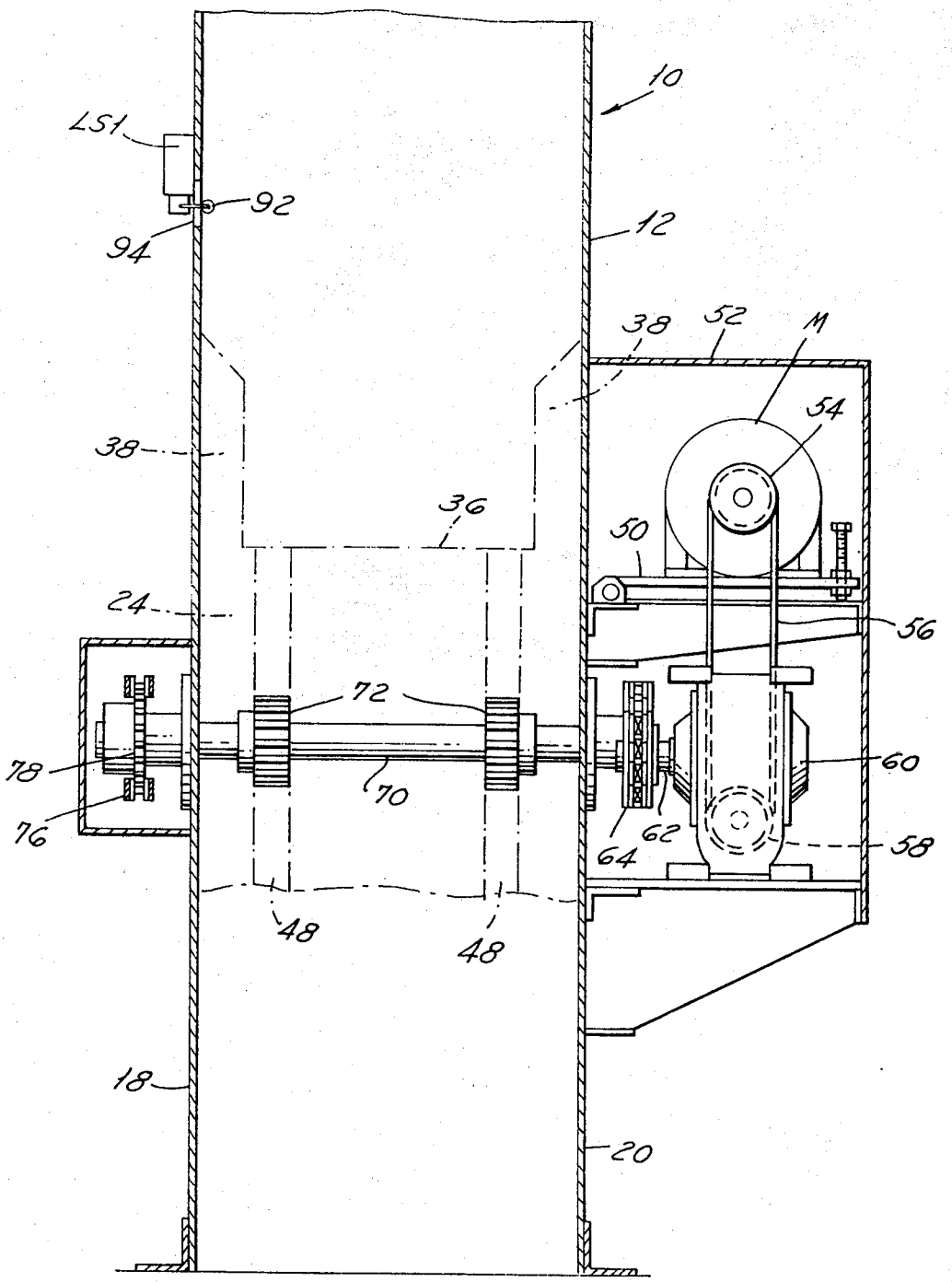
FIG. 3 is a fragmentary sectional view looking to the left in FIG. 1 with parts eliminated for clarity but showing in particular the motor and drive mechanism.
Figure 4:
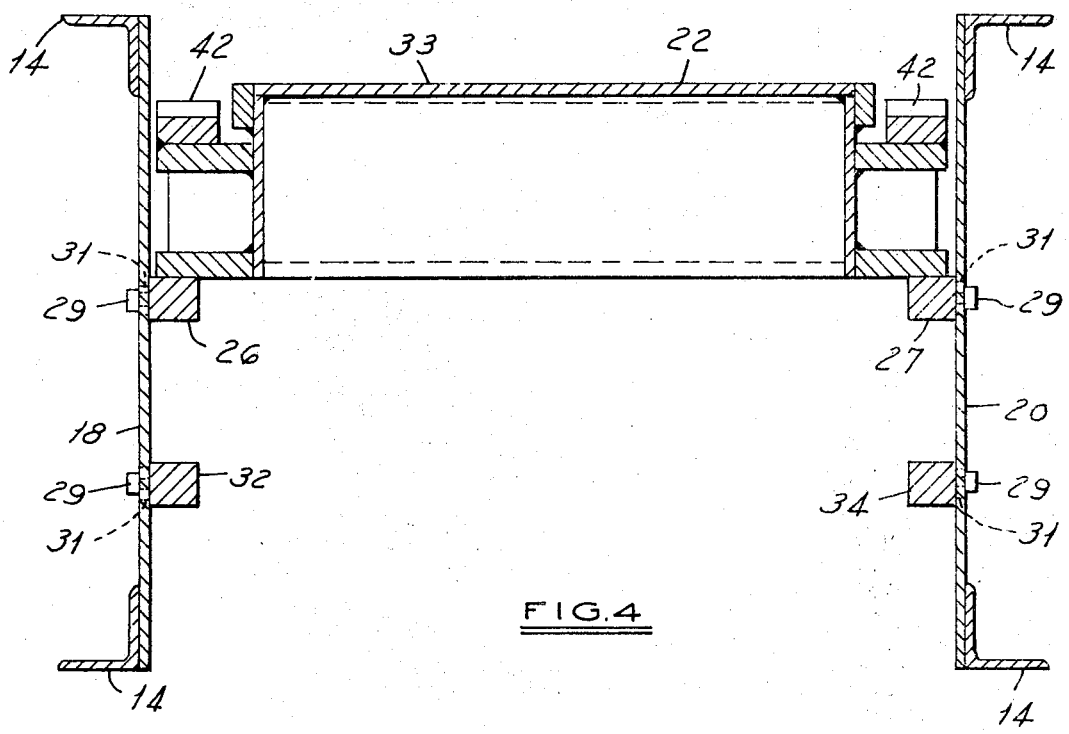
FIG. 4 is a sectional view taken on the line 4—4 in FIG. 1.

The loader includes front and rear elevators or rams 22 and 24 which are reciprocable up and down within and parallel to the longitudinal center line of the frame. Longitudinally extending guides or rails 26 and 27 are secured by fasteners 29 to the side walls 18 and 20 and are provided to guide the up and down movement of the front ram 22, as seen in FIG. 4. The fasteners 29 extend through the elongated transverse slots 31 in side walls 18 and 20 so the rails can be adjusted as required forwardly and rearwardly. The front ram 22 is a flat, generally rectangular member having a front plate 33 parallel to guides 26,27 and a top parts-lifting platform or shelf 28 which slopes downwardly and to the rear. The elevator has side retainer members or arms 30 projecting upwardly from each side of the platform 28 to laterally confine parts on the platform and prevent them from dropping between the ram and the side walls 18 and 20. These arms 30 are similar to the arms 38 of ram 24 shown in FIG. 3.

The rear elevator or ram 24 is also in the form of a flat, generally rectangular member and is guided for up and down movement by spaced longitudinally extending guides or rails 32 and 34 which are parallel to rails 26,27. Rails 32 and 34 are secured by fasteners 29 to the side walls 18 and 20. The fasteners 29 extend through the elongated transverse slots 31 in side walls 18 and 20 so the rails can be adjusted as required forwardly and rearwardly. The ram 24 has a front plate 37 parallel to guides 32, 34 and a parts-lifting platform or shelf 36 at the top which slopes downwardly to the rear at the same angle as the lifting platform 28 of ram 22. The front plate 37 supports parts on the shelf 28 of ram 22 throughout the entire movement of ram 22. The rear ram 24 also has the upwardly extending side retainer members or arms 38 projecting upwardly from opposite sides of the lifting platform 36 to laterally confine the parts and prevent them from dropping between the ram and the side walls 18 and 20.

The upright frame 12 has a rear wall 40 which extends below the lifting platform 36 of the rear ram 24 in its lowermost position shown in FIG. 2. This rear wall 40 is parallel to guide rails 26,27 and 32,34 and is part of a unit 41 which is secured by fasteners 43 to the side walls 18 and 20. The fasteners 43 extend through the elongated transverse slots 45 in the side frame members of unit 41 and hence its rear wall 40 can be adjusted as required forwardly and rearwardly. The rear wall 40 extends upwardly to a discharge chute 44 which is inclined at the same angle as the lifting platform 36 of ram 24. This rear wall 40 supports parts on the lifting platform 36 of the rear ram 24 throughout its entire vertical movement.

Figure 5:
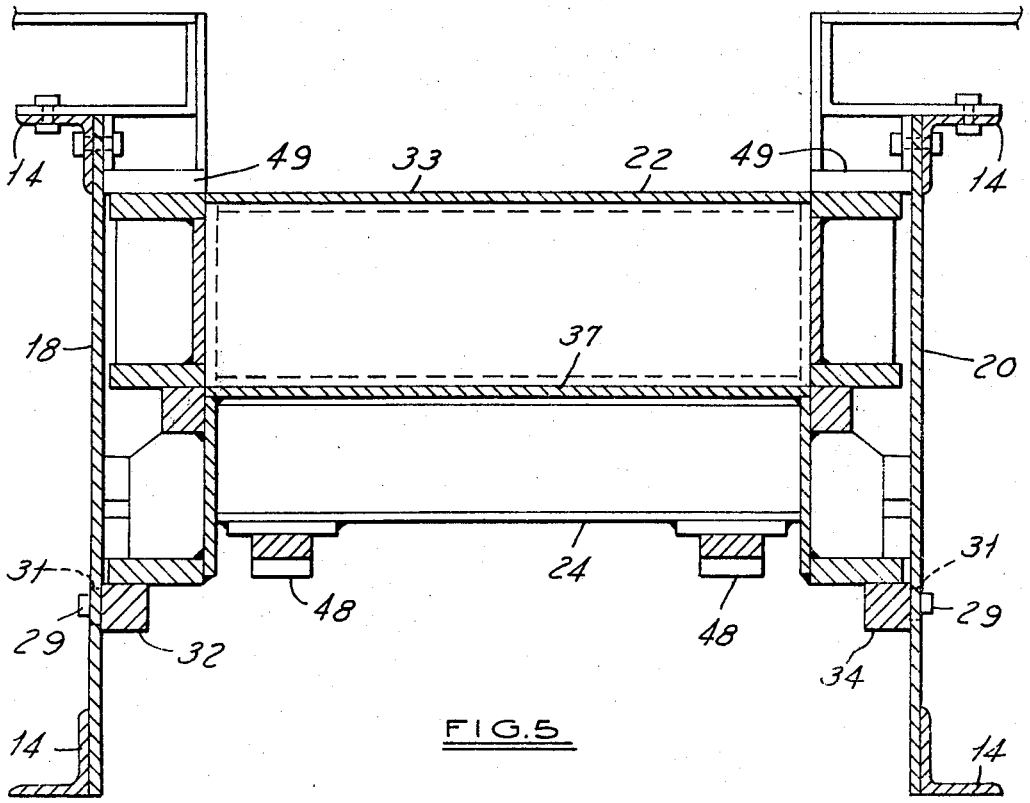
FIG. 5 is a sectional view taken on the line 5—5 in FIG. 1.

A charging chute 45 is mounted on the front of the frame 12 for delivering parts to the lifting platform 28 of the front ram 22. The bottom wall 47 of the charging chute is inclined at the same angle as the lifting platform 28. The charging chute has the side and bottom hopper bars 49 and 51 parallel to and in sliding contact with the front plate 33 of ram 22 as shown in FIG. 5 so that parts on the bottom bar 51 are supported against the front plate 33 as ram 22 moves up and down.

The rear wall 40 and the rams 22 and 24 are adjusted in close sliding contact to prevent parts from jamming or falling away. One such place where jamming can occur is between the bottom hopper bar 51 and the front ram 22. The guide rails 26,27 are adjusted to cause the front plate 33 of ram 22 to move in close sliding contact with the hopper bar 51 to prevent jamming at this point. A second place where jamming can occur is between the two rams at the rear edge of the platform 28 of ram 22. Jamming at this point is prevented by adjusting the guide rails 32,34 to cause the front plate 37 of ram 24 to move in close sliding contact with the rear edge of platform 28 of ram 22.

The third point where jamming can occur is between the rear wall 40 and the rear edge of lifting platform 36 of ram 24. Jamming at this point is prevented by adjusting the unit 41 on which the rear wall 40 is mounted up into close sliding contact with the rear edge of platform 28 of ram 24.

The arms 30 of ram 22 respectively overlie the arms 38 of ram 24 when the rear wall 40 and rams 22,24 are properly adjusted as described in the preceding paragraph, the rear surfaces 30' of arms 30 are parallel to and slidably engageable with the front surfaces 38'; of arms 38, and with the front plate 37 of ram 24, and the rear surfaces 38'' of arms 38 are parallel to and slidably engageable with rear wall 40. The front surfaces 30'' of arms 30 also are parallel to and slidably engageable with the side hopper bars 49.

FIG. 2 shows the front ram 22 at its upper limit and the rear ram 24 at its lower limit. In this position, the lifting platforms 28 and 36 of the two elevators are parallel and flush with one another for transfer of parts from the former to the latter. FIG. 1 shows the front ram 22 at its lower limit so that its lifting platform 28 is flush with the discharge end of charging chute 45 to receive parts from the latter. At the same time, ram 24 is at its upper limit so that its lifting platform 36 is flush with the upper edge of rear wall 40 to discharge parts over the upper edge into the discharge chute 44.

The front ram 22 has a pair of laterally spaced longitudinally extending racks 42 on its front face. The rear ram 24 has a pair of laterally spaced longitudinally extending racks 48 on its rear face. These racks are part of the drive by which the rams are reciprocated up and down as will become apparent from the description which follows.

The drive mechanism for the rams comprises a motor M mounted on a supporting structure 50 within a housing 52 mounted on the side wall 20 of the upright frame. The output shaft of the motor M has a sheave 54 which drives a belt 56 that extends over a sheave 58 on the gear box 60. The output shaft 62 of the gear box has a sprocket 64 over which extends a chain 66 which drives a sprocket 68 on the shaft 70. The shaft 70 has a pair of gears 72 secured therein which mesh with the racks 48 on the rear ram 24. A chain 76 extends over the sprocket 78 on shaft 70 to the sprocket 80 on shaft 82 to drive the latter. Shaft 82 has gears 84 in mesh with the racks 42 on the front ram 22. It will be apparent from the foregoing that the motor when operated in one direction will raise the front ram while lowering the rear ram, and when operated in the opposite direction will lower the front ram while raising the rear ram. This balances the load and places a minimum stress on the drive.

Figure 6:
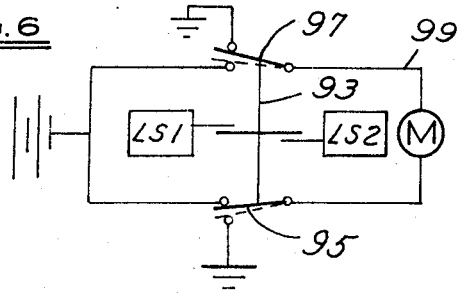
FIG. 6 is an electrical diagram.

Limit switches LS1 and LS2 are provided on the side of the frame having operating elements 92 which project through an opening 94 in the side wall for operation by lugs 96 and 98 on the rear ram. A switch 93 is operated by the limit switches. LS1 when operated moves switch 93 so as to close contact 95 and open contact 97 in the motor circuit 99, (see FIG. 6). LS2 when operated moves switch 93 so as to close contact 97 and open contact 95 thereby reversing motor M. The arrangement is such that when the rear ram reaches its lower limit lug 96 engages the operating arm of LS2 to reverse motor M, and at the upper limit of the rear elevator lug 98 engages the operating arm of limit switch LS1 to again reverse the motor.

Spring assemblies 100 and 102 are provided for cushioning the rams 22 and 24 at the lower limits of their travel. Each spring assembly comprises a supporting base 102 and one or more coil springs 104 to engage the rams. FIG. 1 shows the front ram at its lower limit in contact with the springs 104 of the spring assembly 100. These springs determine the lower limit of travel of the rams and also add power to start the rams on their upward travel.

In operation, parts loaded in the charging hopper 45 fill the lifting platform 28 of the front elevator when the rams are in the FIG. 1 position, that is when the front ram is at its lower limit and the rear ram at its upper limit. At the same time, the rear ram is at its upper limit so that parts on the lifting platform 36 of the rear ram are discharged over the upper edge of the rear wall.

Reversal of the motor M causes the front ram to rise to its upper limit and the rear ram to descend to its lower limit in which position the lifting platforms 28 and 36 of the two rams are flush as shown in FIG. 2 so that parts may be transferred from the lifting platform of the front ram to that of the rear ram. A subsequent reversal of the motor lowers the front ram to pick up more parts and raises the rear ram to the discharge level.

Adjustment of the rams to prevent jamming is simple. Fasteners 43 for the rear wall 40 and fasteners 29 for guide rails 26,27 and 32,34 are loosened so that the rams and rear wall can be adjusted forwardly, and then the fasteners are re-tightened. When the hopper, rams and rear wall are in proper sliding contact, the parts will not jam. The arms 38,30 of the rams prevent parts from jamming between the rams and the side walls 18,20 of the frame.

What I claim as my invention is:

1. A parts loader comprising a frame, two elevators each having a parts-supporting shelf, means on said frame guiding the first elevator for up and down reciprocation, means on said frame guiding the second elevator for up and down reciprocation alongside and parallel to said first elevator, said first elevator having a front wall in sliding contact with the rear edge of the shelf of said second elevator, a rear wall mounted on said frame in sliding contact with the rear edge of the shelf of said first elevator, and reversible drive means for reciprocating said elevators simultaneously in opposite directions to substantially balance the load, said drive means being operable in one direction to move said first elevator up to a discharge point while moving said second elevator down to a loading point and operable in the opposite direction to move said first elevator down and said second elevator up to a point where said shelves are substantially contiguous and flush for the transfer of a load of parts from the shelf of the second elevator to that of the first, said shelves being inclined with respect to the horizontal downwardly and rearwardly to facilitate the gravity transfer of the parts.

2. The loader defined in claim 1, wherein said drive means comprises a rack and gear mechanism.

3. The loader defined in claim 1, wherein said frame has side walls along opposite sides of said elevators, and each elevator has arms extending upwardly from opposite sides of the shelf thereof to prevent parts on said shelves from falling between said side walls and said elevators.

4. The loader defined in claim 2, including a charging hopper mounted on the front of said frame, said charging hopper having a bottom wall inclined downwardly and rearwardly and terminating in an outlet end, said second elevator having a front wall in sliding contact with the outlet end of said bottom wall of said hopper, said shelf of said second elevator when the latter is moved down to its loading point being substantially contiguous and flush with the outlet end of the bottom wall of said hopper for the transfer of a load of parts from said hopper to the shelf of said second elevator.

* * * * *